US009151534B2

(12) United States Patent
Lee et al.

(10) Patent No.: US 9,151,534 B2
(45) Date of Patent: Oct. 6, 2015

(54) LATCH ASSEMBLY AND REFRIGERATOR OR HOME APPLIANCE INCLUDING THE SAME

(71) Applicant: LG ELECTRONICS INC., Seoul (KR)

(72) Inventors: Jaeyoul Lee, Changwon-si (KR); Seungho Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/077,853

(22) Filed: Nov. 12, 2013

(65) Prior Publication Data

US 2014/0132145 A1 May 15, 2014

(30) Foreign Application Priority Data

Nov. 12, 2012 (KR) ..... 10-2012-0127274
Nov. 12, 2012 (KR) ..... 10-2012-0127343

(51) Int. Cl.
*F25D 23/00* (2006.01)
*F25D 23/02* (2006.01)
*E05C 19/02* (2006.01)

(52) U.S. Cl.
CPC ..... *F25D 23/028* (2013.01); *E05C 19/022* (2013.01); *F25D 2323/023* (2013.01); *F25D 2323/024* (2013.01); *Y10T 292/1051* (2015.04)

(58) Field of Classification Search
CPC ..... F25D 23/028; F25D 23/02; F25D 23/025; F25D 2323/02; F25D 2323/023; E05Y 2900/31
USPC ..... 312/405, 405.1, 321, 326–329, 309, 312/310; 292/194, 195, 198, 216, DIG. 71
See application file for complete search history.

(56) References Cited

U.S. PATENT DOCUMENTS

| | | | | |
|---|---|---|---|---|
| 2003/0132690 | A1* | 7/2003 | Shin et al. | 312/405 |
| 2006/0138920 | A1* | 6/2006 | Jang | 312/405 |
| 2006/0226750 | A1* | 10/2006 | Lee et al. | 312/405.1 |
| 2006/0226751 | A1* | 10/2006 | Park | 312/405.1 |
| 2008/0278049 | A1* | 11/2008 | Park et al. | 312/405 |
| 2009/0009043 | A1* | 1/2009 | Gwak | 312/405.1 |
| 2009/0261701 | A1* | 10/2009 | Yun et al. | 312/405 |
| 2010/0084956 | A1* | 4/2010 | Kim et al. | 312/405.1 |
| 2010/0281911 | A1* | 11/2010 | Ha | 62/449 |
| 2011/0072846 | A1* | 3/2011 | Engel et al. | 62/449 |
| 2011/0187255 | A1* | 8/2011 | Ryu et al. | 312/405 |
| 2014/0009055 | A1* | 1/2014 | Cho et al. | 312/405 |

* cited by examiner

*Primary Examiner* — Daniel Rohrhoff
(74) *Attorney, Agent, or Firm* — Ked & Associates, LLP

(57) ABSTRACT

A refrigerator including a home bar is provided. The refrigerator may include a latch assembly that releasably couples a door of the home bar to a door of the refrigerator to selectively provide access to an interior of the home bar without opening the main refrigerator door. The latch assembly may include a holder provided in one of the home bar door or the main refrigerator door, and a latch provided in the other of the home bar door or the main door. The latch may be selectively coupled to the holder to lock and unlock the home bar door. The latch locks the holder by changing elastic rotation of the latch in one direction into elastic restoring rotation in a second, reverse direction as the holder is moved forward into the latch. The latch unlocks the holder as the holder is moved farther forward, and the latch and the holder are decoupled from each other while the latch is elastically rotated in response to backward motion of the holder out of the latch.

22 Claims, 11 Drawing Sheets

LATCH ASSEMBLY AND REFRIGERATOR OR HOME APPLIANCE INCLUDING THE SAME

CROSS-REFERENCE TO RELATED APPLICATION(S)

This application claims priority under 35 U.S.C. §119 to Korean Application No. 10-2012-0127274 filed in Korea on Nov. 12, 2012 and Application No. 10-2012-0127343 filed in Korea on Nov. 12, 2012, whose entire disclosures are hereby incorporated by reference.

BACKGROUND

1. Field

This relates to a home appliance, an in particular, to a latch assembly for a home appliance.

2. Background

A refrigerator may provide cold air to one or more storage compartments formed therein using a refrigerant system to preserve items stored therein at lower than normal temperatures. Such a refrigerator may include a case for defining an exterior appearance thereof and a refrigerator door hingedly coupled to a front of the case to selectively open and close the one or more compartments provided in the case.

BRIEF DESCRIPTION OF THE DRAWINGS

The embodiments will be described in detail with reference to the following drawings in which like reference numerals refer to like elements wherein:

FIG. 10 is a perspective view of a state in which the holder is in contact with the latch;

FIG. 11 is a perspective view of a state in which the latch is rotated by the forward motion of the holder;

FIG. 12 is a perspective view of a state in which the holder is coupled to the latch after moved farther forward;

FIG. 13 is a perspective view of a state in which the coupled holder is decoupled after moving farther forward;

FIG. 14 is a perspective view of a state in which the holder is decoupled after moving backward; and FIG. 15 is a longitudinal sectional view of a state in which the holder is decoupled from the latch after moving backward.

DETAILED DESCRIPTION

Figure 1:
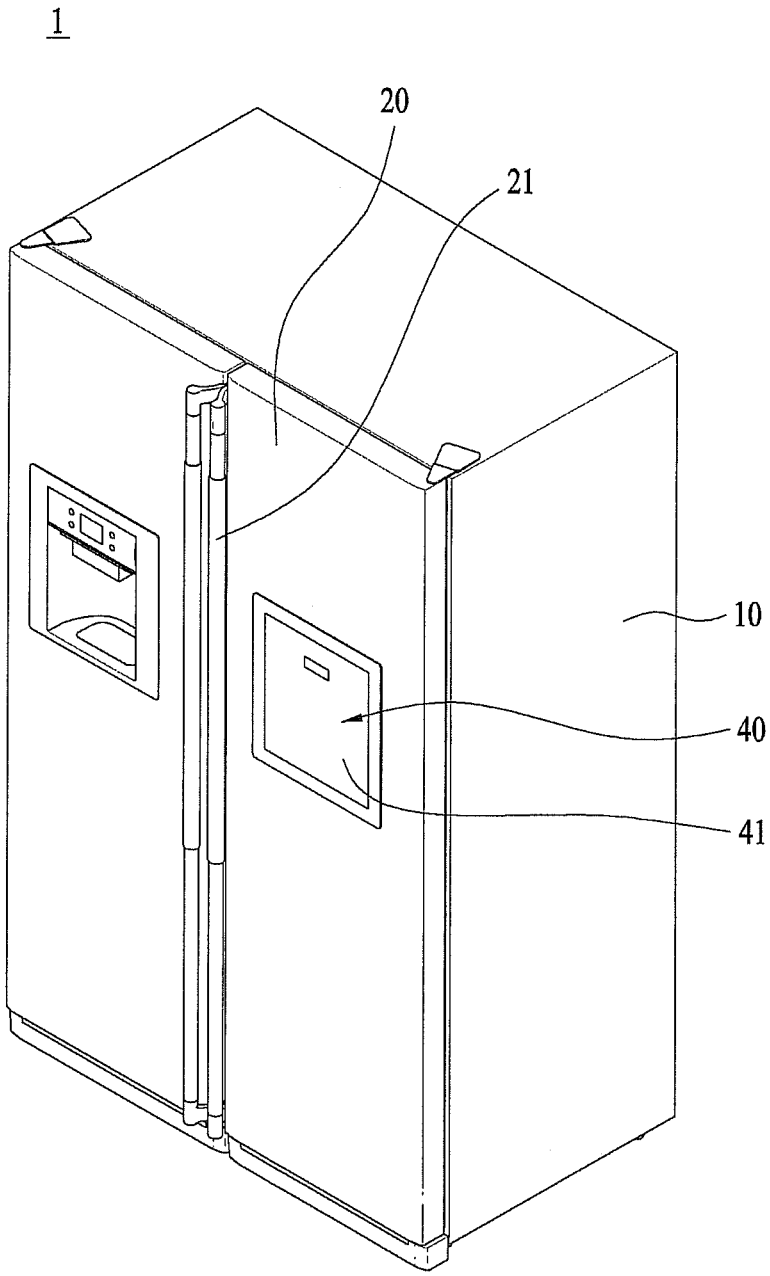
FIG. 1 is a perspective view of a refrigerator according to an exemplary embodiment.

Exemplary embodiments of the disclosed subject matter are described more fully hereinafter with reference to the accompanying drawings. The disclosed subject matter may, however, be embodied in many different forms and should not be construed as limited to the exemplary embodiments set forth herein. The accompanying drawings illustrate a refrigerator as one example of a home appliance. However, a latch assembly which will be described later may be applied not only to a refrigerator but also to a variety of home appliances.

Water, other beverages and the like which may be frequently used may require frequent opening of a refrigerator door, allowing cold air inside the refrigerator compartment to leak to the outside, increasing power consumption. A home bar may be provided in an outer surface of the refrigerator door to decrease the frequency of opening the refrigerator door. Such a home bar may store frequently consumed items, for example, water and other beverages. When opening a home door relatively smaller than the refrigerator door, the water or other beverages stored in the home bar may be easily removed and replaced, and the refrigerator door may remain closed and cold air inside the refrigerator compartment may remain in the refrigerator compartment.

A latch assembly may facilitate the selective opening and closing of such a home bar door, such as, for example, a circular latch including a ball, a spring and two guide units for guiding motion of the ball may selectively open and close such a home bar door. However, the number of parts composing such a structure of the door latch may be relatively large and the overall size of the latch structure may be disadvantageously large. Specifically, such a door latch may be selectively coupled to an annular holder and an operation unit of the door latch may be independently provided from a coupling unit of the door latch, thus increasing the number of parts, and the size of the holder and the door latch.

A large-sized and complicated-structured latch assembly may also detract from space for securing heat insulation in the refrigerator door, further deteriorating heat insulation performance.

When using such an annular holder, a relatively large distance may be required to move the door or holder forward so as to open the home bar door from a closed state, making it difficult to provide for sufficient sealing between the home bar door and the refrigerator door, and allowing for leakage of cold air could between the home bar door and the refrigerator door.

To address this, the annular holder may be vertically mounted in an inner surface of the home bar door. However, when the home bar door is completely open, the holder may project vertically upward from the inner surface of the home bar door, and may be damaged when the user removes or replaces an item from the home bar.

Such a latch assembly may be applied not only to a refrigerator but also to various other home appliances including a door in which a latch assembly configured to selectively open and close the door may be useful.

As shown in FIG. 1, an exemplary refrigerator 1 may include a case 10, a main refrigerator door 20 and a home bar door 40.

The case 10 defines an exterior appearance of the refrigerator 1. In the case 10 may be provided refrigerator and freezer compartments as storage compartments for storing items such as food and beverages. In the storage compartments may be provided a cooling device for generating cold air.

The refrigerator door 20 is hingedly coupled to a front of the case 10 to open and close the refrigerator or freezer compartment selectively. As shown in FIG. 1, the refrigerator door 20 may include a refrigerator compartment door formed in a left portion to open and close the refrigerator compartment and a freezer compartment formed in a right portion to open and close freezer compartment. Such the description may not limit the positions of the refrigerator compartment, the freezer compartment, the refrigerator compartment door and the freezer compartment door. The positions of the refrigerator compartment and the freezer compartment may be reversed or they may be at an upper portion and a lower portion.

The refrigerator door 20 has an outer end typically coupled to the front of the case 10 by a hinge. Such a structure may allow the user to hold a handle 21 to rotate and open the refrigerator door 20 outward.

A home bar door 40 may be provided in the refrigerator door 20. In other words, when the home bar door 40 is in an open position relative to the main door 20, a home bar as a storage chamber may be exposed outside. Such a home bar may be provided in the refrigerator door 20.

Figure 2:
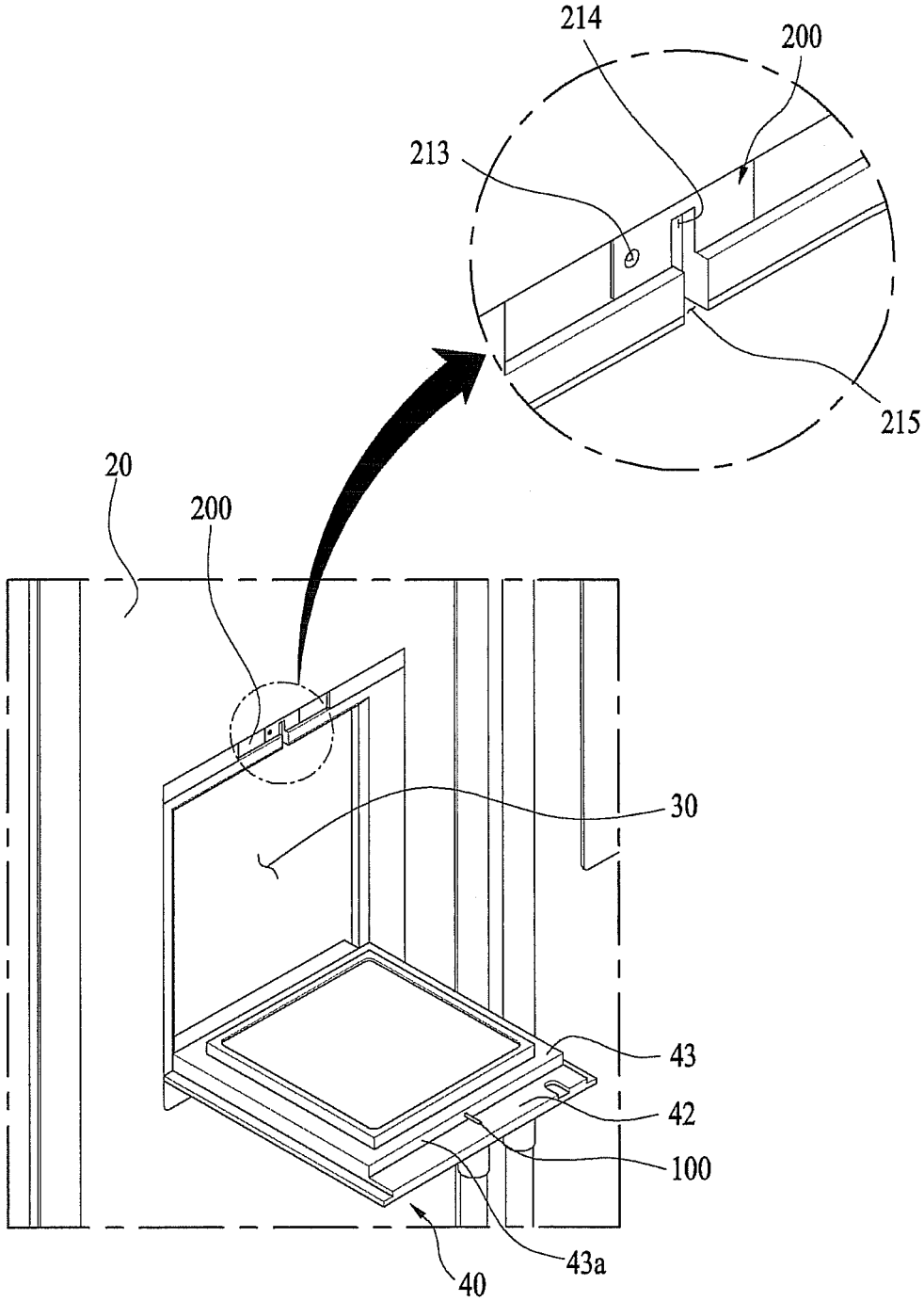
FIG. 2 is a perspective view and a partially enlarged view of a home bar provided in the refrigerator shown in FIG. 1.
Figure 3:
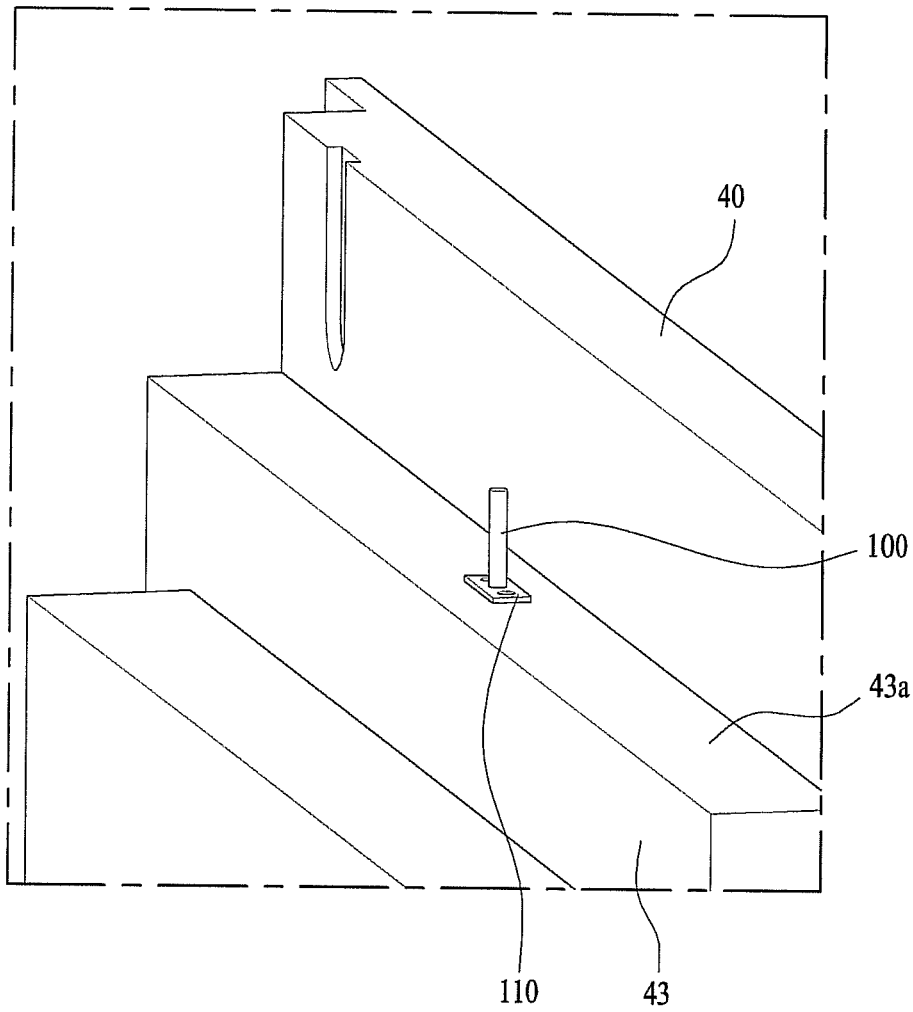
FIG. 3 is a partially enlarged view of a home bar door including a holder according to an exemplary embodiment.

Referring to FIGS. 2 and 3, the home bar 30 and an opening/closing structure of the home bar door 40 according to exemplary embodiments will be described in detail.

The home bar 30 may be provided in the refrigerator door 20 as a storage chamber and the home bar door 40 may open and close the home bar 30.

As one of examples, the home bar door 40 shown in FIG. 2 has one end hingedly coupled to the refrigerator door 20 and the other end rotatable to open and close the home bar 30.

As shown in FIG. 2, the home bar door 40 has a lower end rotatably coupled to the refrigerator door 20 and an upper end rotatable about the lower end to selectively open and close the home bar 30. In this instance, the home bar door 40 can be rotated in an open direction due to its weight and user convenience can be enhanced. In other words, the home bar door 40 may be opened due to gravity. An elastic restoring force can be activated from a closed state to an open state. Specifically, when the home bar door 40 is rotated in the open direction, elasticity may be generated in a lower hinge portion of the home bar door 40. When an external force applied by the user is removed, the home bar door 40 may be rotated by the elastic restoring force.

Such description may not limit the coupling structure between the home bar door 40 and the refrigerator door 20 and any structures only capable of selectively opening and closing the home bar 30 can be applied.

The home bar door 40 may include an outer surface 41 and an inner surface 42. A heat insulation material may be provided between the outer surface 41 and the inner surface 42.

The outer surface 41 may be the surface defining an exterior appearance of the refrigerant when the home bar door 30 is closed by the home bar door 40. As shown in FIG. 1, the outer surface 41 may be co-planar with the refrigerator door 20.

The inner surface 42 may be the surface in contact with the home bar 30 as shown in FIG. 2. The inner surface 42 of the home bar door may include a projected portion 43 projected toward the home bar 30, in other words, the inside of the home bar 30. When the home bar door 40 closes the home bar 30, the projected portion 43 may be inserted in the home bar 30. Accordingly, the heat insulation inside the home bar 30 may be performed more efficiently. The projected portion 43 may be projected from the home bar inner surface 42 forward, in a state where the home bar door 40 is closed.

A holder 100 may be provided in the home bar door 40. Specifically, the holder 100 may be provided in the inner surface 42 of the home bar door 40. More specifically, the holder 100 may be provided in an upper surface 43*a* of the projected portion 43 formed in the home bar door 40. The holder 100 may be formed in the upper surface 43*a* of the projected portion 43, substantially in parallel with an installation surface on which the refrigerator 1 is received, when the home bar door 40 is closed.

Accordingly, the holder 100 may be projected in parallel with the inner surface 42 or the outer surface 41 of the home bar door 40. The home bar door 40 shown in FIG. 2 may be extended in a horizontal direction with respect to the installation surface, in a completely open state. Such the projected direction of the holder 100 may reduce collision of the holder 100 with a storage item as much as possible and damage to the holder 100 can be prevented accordingly.

The holder 100 may be inserted in a latch assembly 200 shown in FIG. 2, when the home bar door 40 is closed. The latch assembly 200 may be provided in an upper portion of the home bar 30, with a hole for leading the holder 100 in and out. The latch assembly may include a front hole 214 and a lower hole 215. The latch assembly 200 may be mounted in the refrigerator door 20. When the home bar door 40 is closed, the latch assembly 200 may not be exposed outside.

The positional relationship between the latch assembly 200 and the holder 100 may allow the holder 100 substantially in a vertical position to move forward and backward in the latch assembly 200.

As shown in FIG. 3, the holder 100 may be provided to be substantially vertical in a state where the home bar door 40 is closed. When the upper surface 43*a* of the projected portion 43 is substantially horizontal with respect to the installation surface (i.e., the floor or the ground), the holder 100 may be oriented vertically with respect to the ground. In other words, the holder 100 may extend vertically from the upper surface 43*a*.

The holder 100 may be fixedly coupled to the home bar door 40 by a holder fixing portion 110. The holder 100 may be extended from the upper surface 43*a* in a vertical direction.

Specifically, the holder 100 may be projected from the upper surface 43*a* of the projected portion 43, formed in a cone or cylinder shape. In other words, the holder 100 may have a pin or bar shape and it may have a length or height relatively larger than its width or outer diameter. The shape of the holder 100 is not limited thereto and any shapes selectively coupled to the latch assembly which will be described later may be applicable. In addition, the holder 100 may have a predetermined strength and size sufficient to press a latch 220.

The holder 100 is coupled to or decoupled from the latch 220, in contact with the latch 220. Accordingly, the holder 100 may be formed in a cylinder or cone shape. Such a shape of the holder 100 may allow an outer circumferential surface of the holder 100 to contact the latch 220 smoothly, gently and continuously. Also, it can be possible to realize a small-sized and simply-structured holder 100 and it is also possible to realize a simple-structured and small-sized latch assembly 200.

Figure 4:
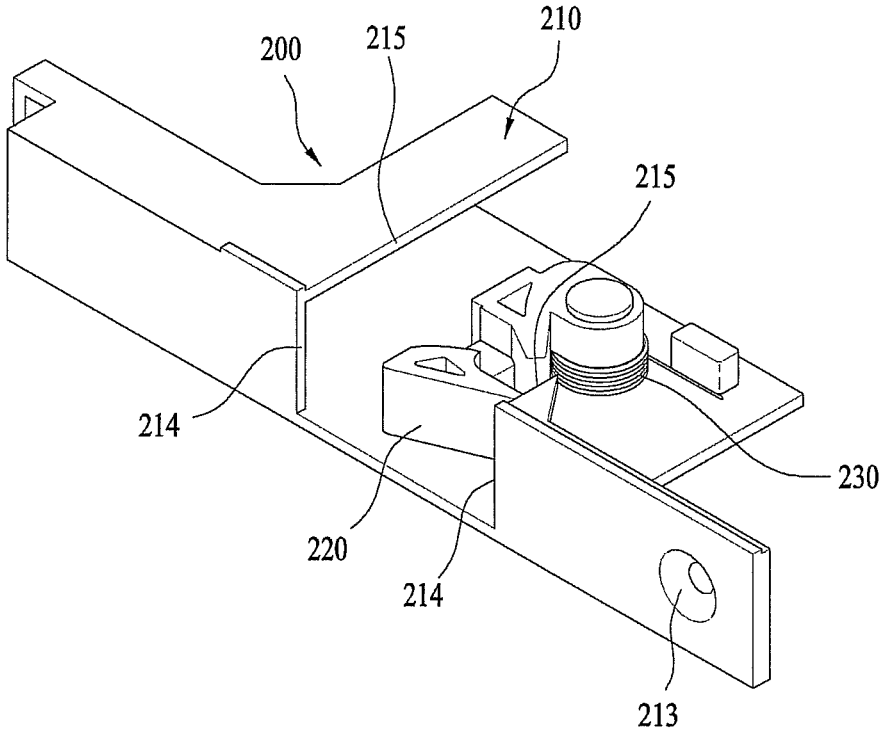
FIG. 4 is a lower perspective view a latch assembly according to an embodiment.
Figure 5:
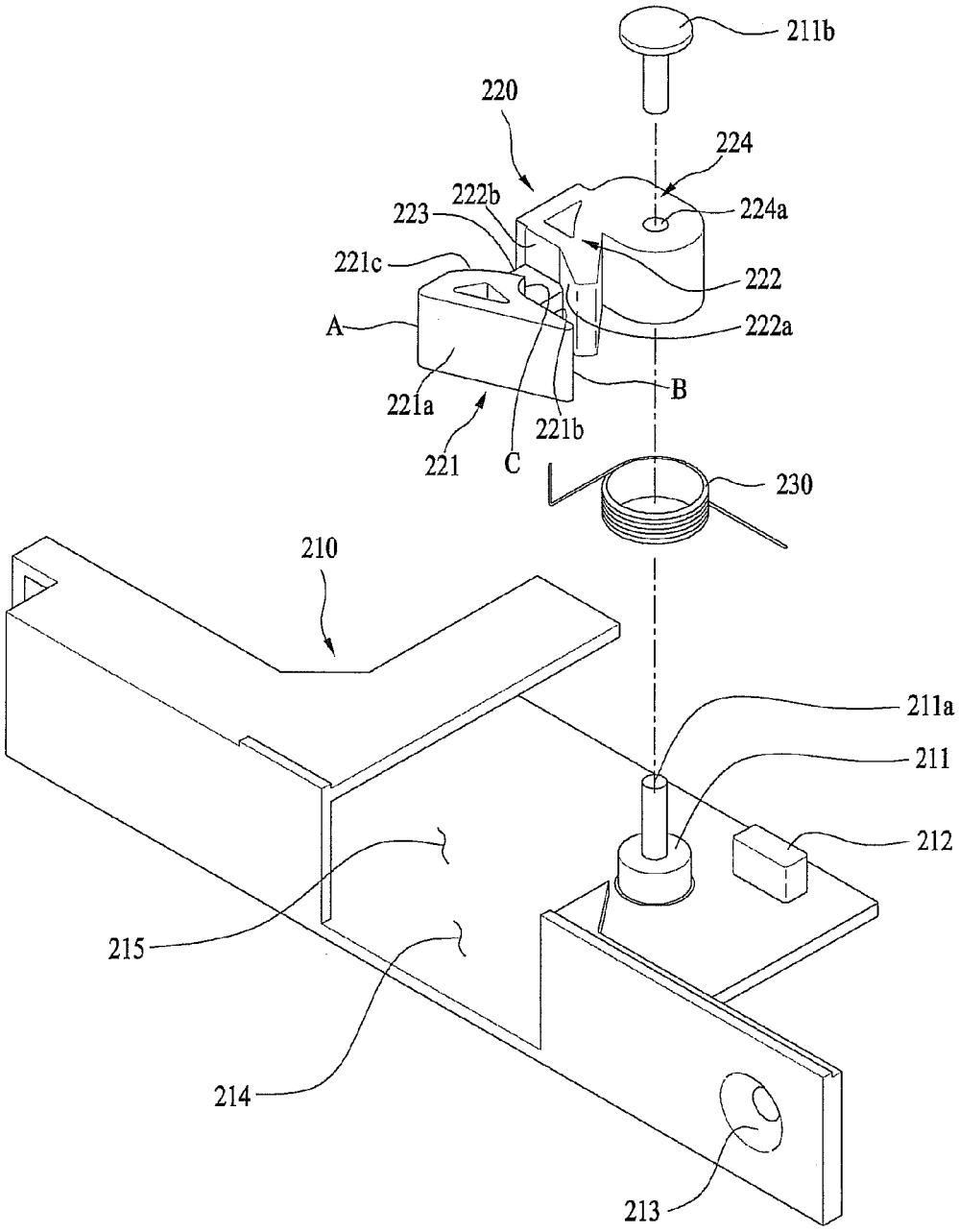
FIG. 5 is an exploded perspective view of the latch assembly shown in FIG. 4.

Referring to FIGS. 4, 5 and 6, the latch assembly 200 according to one embodiment of the present disclosure will be described as follows.

As mentioned above, the latch assembly 200 may be formed in the refrigerator door 20, to be selectively coupled to the holder 100. In other words, when the holder 100 and the latch assembly 200 are coupled to each other, the home bar door 40 may be considered to be in a closed state. When the holder 100 and the latch assembly 200 are decoupled from each other, the home bar door 40 may be considered to be in an open state.

The closed state of the home bar door 40 means that the closed state of the home bar door 40 is maintained even after the external force is removed from the home bar door 40. Accordingly, it can be called "a locked state of the home bar door 40". In opposite, the open state of the home bar door 400 means that the home bar door 40 is rotated to open after the external force applied by the user is removed from the home bar door 40. Accordingly, it can be called "an unlocked state of the home bar door 40".

The latch assembly 200 may include a frame 210 shown in FIG. 4, for example. The frame 210 may define an exterior appearance of the latch assembly 200. The latch assembly 200 can be mounted in the refrigerator door 20 via the frame 210. Here, the frame 210 may receive specific components.

The frame 210 may allow the holder 100 in a vertical position to move into the latch assembly 200 and to move out from the latch assembly 200. Also, the frame 210 may allow the holder 100 inserted in the latch assembly 200 to move forward and backward within the latch assembly 200. Accordingly, the frame 210 may include a hole.

At this time, the forward motion means the motion toward the inside of the refrigerator from the front of the refrigerator door 20 and the backward motion means the motion toward the front of the door 20 from the inside of the refrigerator 1.

Specifically, a front hole 214 and a lower hole 215 may be formed in the frame 210. The holder 100 in the vertical position can insertedly move into the frame 210 or move out from the frame 210 through the front hole 214 and the lower hole 215.

The latch assembly 200 may include a latch 220 and an elastic member 230. The latch 220 may be rotatable along contact with the holder 100 and the elastic member 230 may generate elasticity to rotate and restore the latch 200 elastically.

The frame 210 may have a shaft 211 shown in FIG. 5, in other words, a shaft 211 that defines an axis of rotation of the latch 220. The latch 220 is rotatably coupled to the shaft 211. The elastic member 230 allows the latch 220 to rotate elastically and to restore elastically, such that the elastic member 230 may be also coupled to the shaft 211.

A shaft receiving portion 224*a* may be formed in the latch 220 to receive the shaft 211. Once the shaft 211 is coupled to the shaft receiving portion 224*a*, the latch 220 can rotate on the shaft 211 as its axis.

The latch 220 and the shaft 211 need to be coupled to each other to rotate together and to prevent separation from each other. Accordingly, a coupling pin 211*b* may be further provided. After the latch 220 is inserted in the shaft 211, the coupling pin 211*b* may be coupled to an inserting shaft 211*a* forming a central portion of the shaft 211. A hollow may be formed in one of the coupling pin 211*b* and the inserting shaft 211*a* may be inserted in the hollow. Accordingly, the coupling pin 211*b* and the inserting shaft 211*a* may be rotatably connected to each other. In case the hollow is formed in the coupling pin 211*b*, the coupling pin 211*b* may be insertedly received by the shaft receiving portion 224*a*.

The relations among the shaft receiving portion 224*a*, the shaft 211, the coupling pin 211*b* and the inserting shaft 211*a* may prevent the latch 220 and the shaft 211 from directly contacting each other in a rotation direction. In other words, a frictional force between them toward the rotation direction can be prevented. Accordingly, abrasion of the latch 220 caused by the rotation of the latch 220, especially, abrasion of the shaft receiving portion 224*a* can be prevented.

A hooking protrusion 212 may be formed in the frame 210 and the hooking protrusion 212 may be supported by one end of the elastic member 230.

In addition, a screw hole 213 may be formed in the frame 210 and the screw hole 213 may be provided to fasten the latch assembly 200 to the refrigerator door 20. In other words, the latch assembly 200 may be fastened to the refrigerator door 20 via the screw hole 213 by a screw.

The front hole 214 may provide a passage of the holder 100 to and from the latch assembly 200, especially, the frame 210. Accordingly, the front hole 214 may be big enough for the holder 100 to pass through.

The lower hole 215 may provide a passage of the holder 100 to and from the latch assembly, especially, the frame 210, similar to the front hole 214. The lower hole 215 and the upper hole 214 may be named as independent components to distinguish the latch structure as embodied and broadly described herein from a latch structure using a hook (an annular holder). They may be named as one component, without dividing two components.

The lower hole 215 may be provided under the front hole 214. In one embodiment, the lower hole 215 is provided and the holder 100 extended from the upper surface 43*a* of the projected portion 43 can then be mounted in the latch assembly 200. In other words, when the home bar door 40 is closed, the holder 100 also rotates together with the home bar door 40 and moves into the latch assembly 200. Accordingly, the holder 100 can be accommodated only if the lower hole 215 and the front hole 214 are provided. That is because the holder 100 is inserted in the latch assembly 200, in a vertical position.

As mentioned above, the latch 220 rotates on the shaft 211 and moves to lock or unlock the holder 100 selectively.

As shown in FIG. 5 a latch portion 221 may lock or unlock the holder 100, while directly contacting with the holder 100. Also, the latch 220 may include a shaft coupling portion 224 to be coupled to the shaft 211.

The latch portion 221 shown in FIG. 5 may include a first guide portion 221*a*, a locking portion 221*b* and a second guide portion 221*c*.

The first guide portion 221*a* may be provided at a rear portion of the latch portion 221. The locking portion 221*b* and the second guide portion 221*c* may be provided in front of the first guide portion 221*a*. Accordingly, when the holder 100 moves forward, the first guide portion 221*a* contacts the holder 100 first.

Specifically, the latch 221 may have three corners (A, B and C) shown in FIG. 5, seen from the bottom. One surface connecting the first corner (A) to the second corner (B) may be the first guide portion 221*a* and another surface connecting the second corner (B) to the third corner (C) may be the locking portion 221*b*. The other surface connecting the third corner (C) to the first corner (A) may be the second guide portion 221*c*.

The first guide portion 221*a* may generate the rotational motion of the latch 220 to lockingly seat the holder 100 on the locking portion 221*b*, when the home bar door 40 is closed. The first guide portion 221*a* may have a slope to guide the rotational motion of the latch 220.

When the user pushes the home bar door 40 to close the home bar door 40, the holder 100 pushes the first guide portion 221*a* provided in the rearmost position and moves into the latch portion 221. At this time, the first guide portion 221*a* contacts the holder 100 to rotate the latch 220. When the holder 100 moves farther forward, the holder 100 is decoupled from the first guide portion 221*a* and is seated on the locking portion 221*b*.

The locking portion 221*b* is provided in front of the first guide portion 221*a* and provides a space where the holder 100 is seated. The locking portion 221*b* may be formed, for example, in a hook shape not to be separated without the external force, when the holder 100 is seated on the locking portion 221*b*.

The second guide portion 221*c* may be extended from the locking portion 221*b* and guide the holder 100 from separating from the latch 220. The second guide portion 221*c* may be, for example, concavely rounded as shown in FIG. 5.

The coupling and decoupling between the holder 100 and the latch portion 221 is described as follows.

The holder 100 may be configured to move forward and backward via the hole of the latch assembly 200, when the home bar door 40 is locked (closed) and unlocked (open).

When the home bar door 40 is closed, the holder 100 moves forward in the latch assembly 200 and the holder 100 contacts the first guide portion 221*a* of the latch 220 first. Specifically, the latch 220 rotates in one direction, as an outer surface or outer circumferential surface of the holder 100 contacts the first guide portion 221*a* first. In other words, as it moves forward, the holder 100 applies a force to the first guide portion 221*a* and the latch 220 rotates. At this time, the elastic member 230 is elastically transformed and the latch 220 is rotated against the elasticity. Such rotation may be elastic rotation.

When the holder 100 it moves farther forward, the holder 100 is decoupled from the first guide portion 221*a*. At this time, the latch 220 is rotated in the opposite direction and the holder 100 contacts the looking portion 221*b*. Accordingly, the holder 100 maintains the locked state of the home bar door 40, while it is in contact with the locking portion 221*b*. In this instance, the external force applied to close the home bar door 40 is removed already and the opposite direction rotation of the latch 220 may be the elastic restoring rotation generated by the elastic restoring force of the elastic member 230.

Specifically, when the holder 100 is decoupled from the first guide portion 221*a*, the force transmission between the holder 100 and the latch 220 may finish. At this time, the latch 220 performs elastic restoring rotation in the reverse direction of the former rotation direction. Such elastic restoring rotation may allow the outer surface or outer circumferential surface of the holder 100 to lock the holder 100, contacting the locking portion 221*b*.

In a state where the holder 100 is locked, the user may push the home bar door 40 to open the home bar door 40. The holder 100 in the locked state may be moved farther forward by the external force applied by the user.

When moved farther forward, the holder 100 may be decoupled from the locking portion 221. In this separation process, the latch 220 may perform the elastic restoring rotation or elastic rotation in the opposite direction. If the holder 100 is decoupled from the locking portion 221*b* in any case, the second guide portion 221*c* may contact the holder 100.

When the locking portion 221*b* is decoupled from the holder 100, the latch 220 is rotated in the opposite direction. In other words, the latch 220 is rotated in the reverse direction of the rotation generated during the contact between the holder 100 and the first guide portion 221*a*.

When the user pushes the home bar door 40 after that, the home bar door 40 is opened due to its weight and/or the elasticity applied to the home bar door 40. In other words, the holder 100 is moved backward.

The distance of the forward movement performed by the holder 100 to decouple from the locking portion 221*b* may be quite short. For example, even when it is moved forward as far as a distance shorter than the outer diameter of the holder 100, the holder 100 may be decoupled from the locking portion 221*b*. In other words, even when the holder 100 is moved forward as far as a distance which is the same as or shorter than the outer diameter of the holder 100, the holder 100 can be decoupled from the locking portion 221*b*.

That means that the distance required to move from the closed state to the open state of the home bar door 40 can also be shorter by a similar amount. In other words, the sealing between the home bar door 40 and the door 20 in the closed state of the home bar door 40 can be good.

On the contrary, as the distance to move from the closed state to the open state of the door 40 increases, the sealing between the home bar door 40 and the door 20 might be deteriorated, as it may be difficult to maintain a seal between the home bar door 40 and the refrigerator door 20 through a long distance.

Accordingly, it can be possible to provide good sealing between the home bar door 40 and the refrigerator door 20 using a pin or bar shaped holder 100 according to this embodiment because the distance of the forward motion performed by the home bar door 40 in the closed state can be quite short. The coupling between the holder 100 and the latch 220 can be unlocked, even though this distance is quite short.

Meanwhile, the holder 100 may rotate the latch 220, while contacting the second guide portion 221*c*. At this time, the rotation of the latch 220 may be the elastic rotation. Specifically, the latch 220 may be rotated against the elasticity of the elastic member 230 and the holder 100 may be decoupled from the latch 220 completely during the elastic rotation. As the latch 220 is rotated, the holder 100 is moved farther backward enough to decouple the holder 100 from the latch 220 completely.

After that, the home bar door 40 may be completely opened due to its weight and/or the elasticity and it is in a state shown in FIG. 2.

While the holder 100 is in contact with the second guide portion 221*c*, the latch 220 performs the elastic rotation. The home bar door 40 is open as elastically transforming the elastic member 230, such that drastic opening of the home bar door 40 may be prevented.

When slowly releasing the force applied to the home bar door 40 to push it forward to the maximum distance, the user can feel the elasticity of the elastic member 230 in the hand. It is possible to open the home bar door 40 gently and efficiently.

In this embodiment, the latch 220 may be rotated in the reverse direction, when the holder 100 contacts the second guide portion 221*c*. The rotation of the latch 220 may be the horizontal rotation with respect to the shaft 211.

Meanwhile, when the holder 100 is decoupled from the locking portion 221*b* in this embodiment, the latch 220 may be rotated in the reverse direction by the elastic restoring force and in one direction by the elasticity. In the latter case, a third guide portion 222*a* may be provided and the third guide portion 222*a* contacts the holder 100 when the holder 100 is decoupled from the locking portion 221*b* and moved farther forward. The third guide portion 222*a* may perform a function of guiding the holder 100 to the second guide portion 221*c* before the holder 100 contacts the second guide portion 221*c*.

The third guide portion 222*a* is provided in front of the locking portion 221*b* and it may elastically rotate the latch 220 in the reverse direction when moved farther forward, in contact with the holder. After that, when the forward moving of the holder 100 stops, the holder 100 contacts the second guide portion 221*c*. In this position, the external force applied by the user is released and the holder 100 is moved backward, while contacting the second guide portion 221*c*.

In this embodiment, the latch portion 221 of the latch 220 may include the first guide portion 221*a*, locking portion 221*b* and second guide portion 221*c*, and a shaft coupling portion 224 to be coupled to the shaft 211, the shaft coupling portion 224 including the shaft receiving portion 224*a*. The latch 220 may include a connecting portion 222 between the shaft coupling portion 224 and the latch portion 221. The connecting portion 222 may be spaced apart a predetermined distance from the latch portion 221 and the rotational motion of the latch 220 is generated by the external force applied to the holder 100. The connecting portion 222 may include a third guide portion 222*a* and a fourth guide portion 222*b* as shown in FIG. 5.

The third guide portion 222*a* may guide the rotational motion of the latch 220 to decouple the holder 100 out of the latch assembly 200. The third guide portion 222*a* may include an inclined surface to guide the rotational motion of the latch 220. When the user pushes the home bar door 40 to open the home bar door 40, the holder 100 pushes the third guide portion 222*a*. At this time, the third guide portion 222*a* guides the latch 220 to rotationally move so decouple the holder 100 out of the latch assembly 200.

The first guide portion, the locking portion, the second guide portion and the third guide portion may contact an outer circumferential surface of an end of the holder 100. The end of the holder 100 has to pass through the latch 220. The third guide portion 222*a* and the locking portion 221*b* may be distant from each other via a channel 223 provided there between. In other words, the connecting portion 222 may include the channel 223 and the channel 223 may form a space where the holder passes through the latch 220.

The connecting portion 222 may include a fourth guide portion extending from the third guide portion 222*a*, inclined more gently than the inclined surface of the third guide portion 222*a*.

The latch portion 221 is connected with the connecting portion 222 via the channel 223. The holder 100 is decoupled from the latch, after passing through the channel 223. Accordingly, the height and shape of the channel 223 may be set to be sufficient for the holder 100 to pass through the channel 223.

FIG. 5 shows that the channel 223 is lower than the latch portion 221 and the connecting portion 222. In one embodiment, such structure may allow the holder 100 to pass through the connecting portion 222, without contacting with the connecting portion 223. Accordingly, a surface horizontal with the bottom surface of the holder 100, in other words, an outer circumferential surface of the holder 100 may not contact the connecting portion 223.

As mentioned above, one end of the elastic member 230 may be supported by the hooking protrusion 212 of the frame 210 and the other end of the elastic member 230 may be supported by a supporting portion of the elastic member formed in the latch 220. When the latch 220 is rotated, the end of the elastic member 230 is stopped and the other end is relatively rotated. Accordingly, when the latch 220 is rotated, the elasticity may be generated. The elastic member 230 may be, for example, a torsion spring but the elastic member is not limited thereto. Any type of elastic member capable of providing the elasticity to the latch 220 can be applied.

Accordingly, the external force is applied to the latch 220 and the latch 220 is rotated in one direction against the elasticity of the elastic member 230. When the external force is released, the latch 220 is rotated in the reverse direction by the elastic restoring force.

The opening and closing process of the home bar door provided in the refrigerator 1, according to one embodiment, will be described with reference to FIGS. 6A-6E, which provide a bottom view of the holder 100 and latch assembly 200.

First of all, when closing the home bar door 40 from an open state, the user pushes and raises one end of the home bar door 40. At this time, the other end of the home bar door 40 is hingedly coupled to the refrigerator door 20 and one end of the home bar door 40 is rotationally moved with respect to the other end of the home bar door 40.

As one end of the home bar door 40 is rotated, the holder 100 extended from the upper surface 43*a* of the home bar door 40 passes through the holes 214 and 215 and moves forward into the latch assembly 200.

Figure 6A:
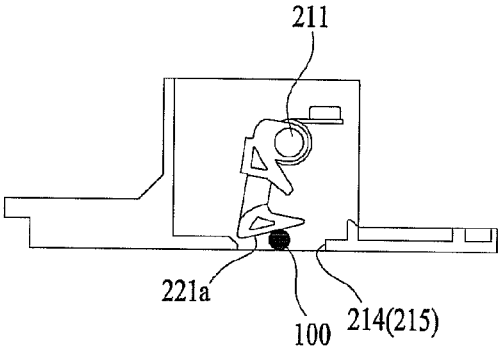
FIGS. 6A-6E are lower perspective views of the latch assembly shown in FIGS. 4 and 5, illustrating an opening and closing of a home bar door provided in a refrigerator, according to one embodiment.

The holder 100 after passing through the holes 214 and 215 contacts the first guide portion 221*a* of the latch 220 as shown in FIG. 6A. Even at this time, the user is applying the external force to close the home bar door 40 continuously and the holder 100 pushes the first guide portion 221*a* farther forward. The first guide portion 221*a* is sloped and the latch 220 is rotationally moved with respect to the shaft 211. In other words, the latch 220 is elastically rotated in a clockwise direction.

Figure 6B:
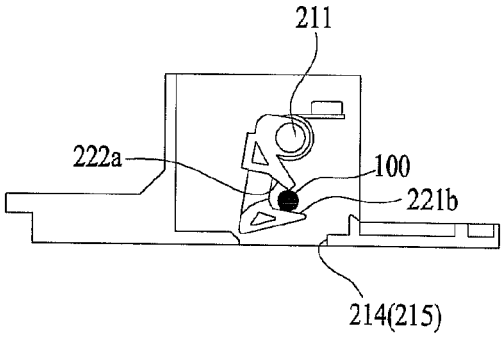

Once the holder 100 passes the first guide portion 221*a* completely due to rotation of the latch 220 with respect to the shaft 211 (in other words, the forward motion of the holder 100), the holder 100 may be inserted between the locking portion 221*b* and the third guide portion 222*a* as shown in FIG. 6B. Once the holder 100 passes the first guide portion 221*a* completely, the external force applied to the first guide portion 221*a* is removed and the latch 220 returns to its original position due to the elastic restoring force generated by the elastic member 230. In other words, the latch 220 performs the elastic restoring rotation in the counter-clockwise direction.

Figure 6C:
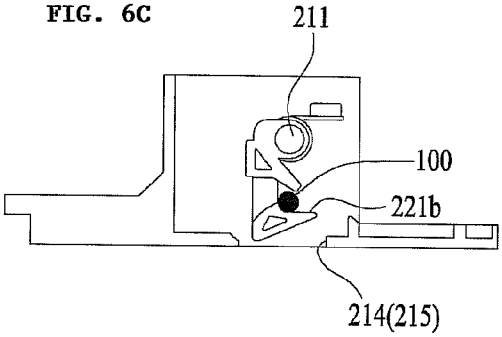

After that, the user removes the external force applied to the home bar door 40 and the holder 100 is seated in the locking portion 221*b* as shown in FIG. 6C. With the holder 100 seated in the locking portion 221*b*, the home bar door 40 is in the closed state.

Unless another external force is applied, the closed state of the home bar door 40 shown in FIG. 6C is maintained.

Figure 6D:
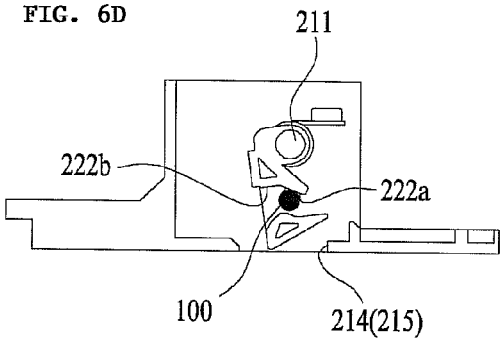

When the user pushes the outer surface 41 of the home bar door 40, near the holder 100, to open the home bar door 40, the holder 100 moves farther forward and presses the third guide portion 222*a* as shown in FIG. 6D. At this time, the inclined direction of the third guide portion 222*a* has to be the reverse of the inclined direction of the first guide portion 221*a*, such that the holder 100 can be decoupled from the locking portion 221*b* easily.

In other words, the holder 100 presses the third guide portion 222*a* to rotate the latch 220 in the reverse direction such that the holder 100 can be decoupled from the locking portion 221*b*.

However, the holder can be decoupled from the locking portion 221*b* by the reverse direction rotation generated by the elastic restoring rotation of the latch 220, not by the pressing of the third guide portion 222*a*. Specifically, when the contact between the locking portion 221*b* and the holder 100 is unlocked by the forward motion of the holder 100, the holder 100 may be in contact with the second guide portion 221*c* by the elastic restoring rotation of the latch 220.

Figure 6E:
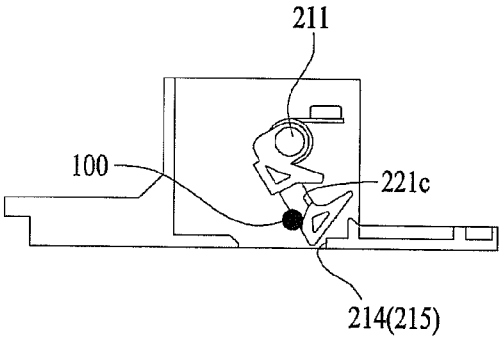

When the force applied to the home bar door 40 by the user is removed, the holder 100 is spaced apart a predetermined distance from the third guide portion 222*a* as shown in FIG. 6E and it contacts the second guide portion 221*c*. In this instance, one end of the home bar door 40 may be rotated and moved downward by the weight of the home bar door 40 and one end of the home bar door 40 may be rotated by using the elastic member provided in the other end having the hinge coupling. In other words, the holder 100 may be decoupled from the latch 220 while it is moved backward.

At this time, the holder 100 may elastically rotate the latch 220 in the counter-clockwise direction, while contacting the second guide portion 221*c*. In the process of decoupling the holder 100 from the latch 220, the holder 100 is moved backward while contacting the second guide portion 221*c* extended from the locking portion 221*b* formed in a concave shape.

After that, the holder 100 is decoupled from the latch 220 completely and the home bar door 40 is open.

Figure 7:
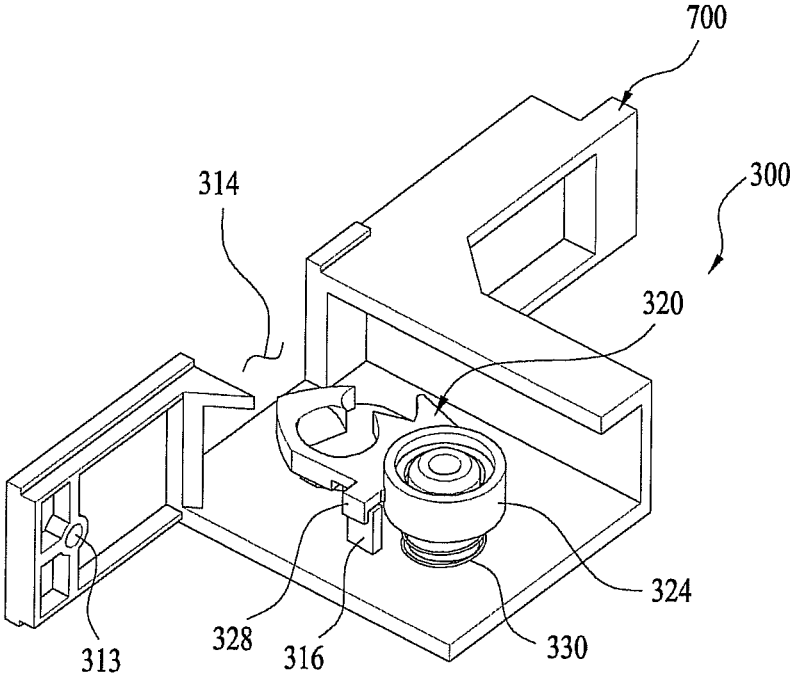
FIG. 7 is a lower perspective view of a latch assembly according to another embodiment.
Figure 8:
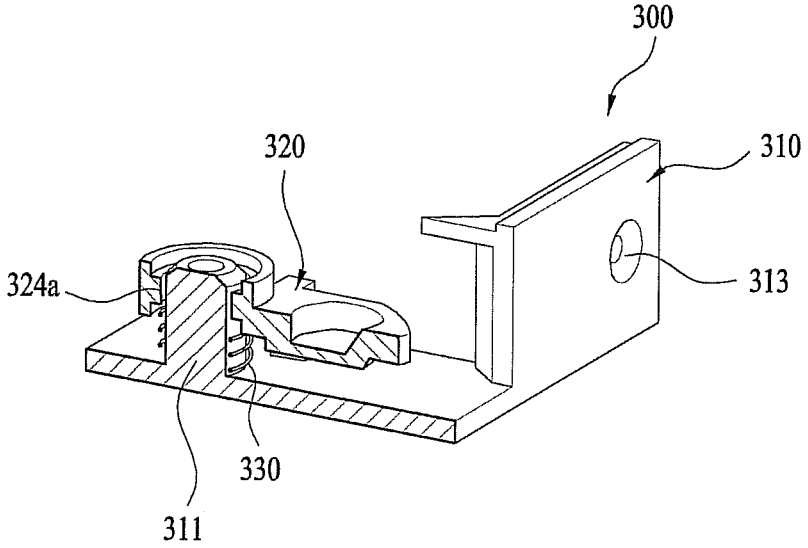
FIG. 8 is a longitudinal sectional view of the latch assembly shown in FIG. 7.
Figure 9:
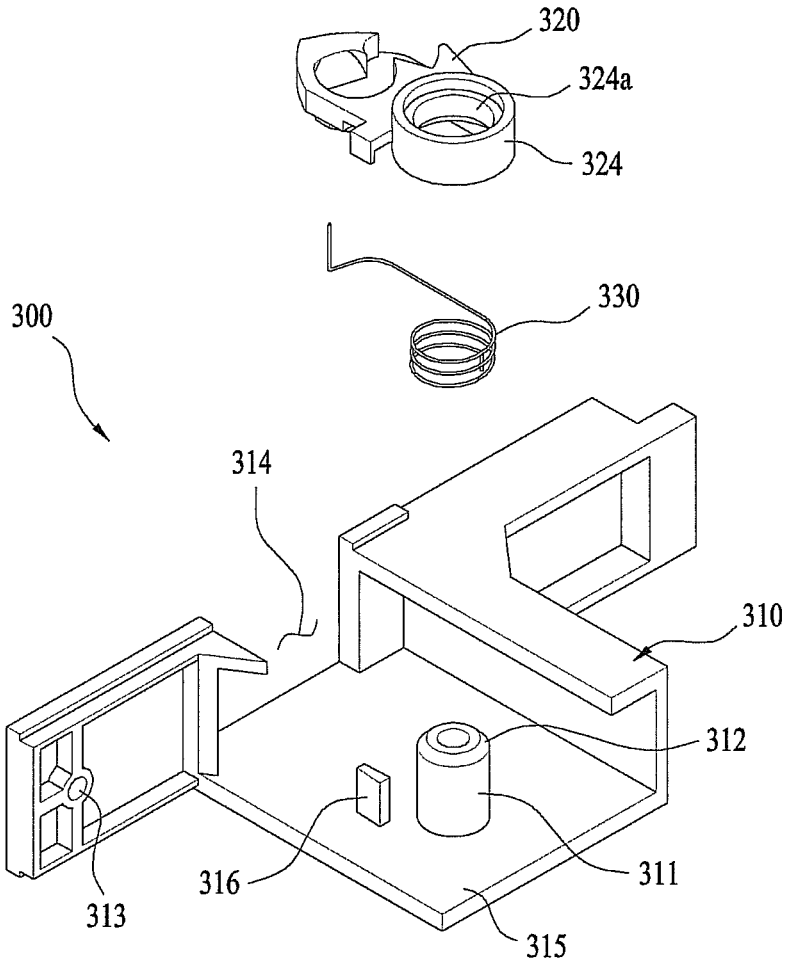
FIG. 9 is an exploded perspective view of the latch assembly shown in FIG. 7.

Referring to FIGS. 7, 8 and 9, a latch assembly 300 according to another embodiment is described in detail as follows. FIGS. 8, 9 and 9 are bottom perspective or sectional views of the latch assembly 300.

In this embodiment, the latch assembly 300 may include a latch 320 and a frame 310 accommodating the latch 320. The holder 300 according to this embodiment may be similar to or the same as the holder according to the embodiment described above. The latch assembly 300 may be coupled to or decoupled from the holder 100 similarly.

The frame 310 may be embedded in the door 20 in which the home bar 30 is formed. A screw hole or a bolt hole 313 may be formed in a predetermined portion of the frame 310 to fix the frame 310 to the refrigerator door 20. Accordingly, the frame 310 may be fixed to the refrigerator door 20 by a screw or bolt.

As shown in FIG. 2, the latch assembly 300 may be mounted in the door 20 so that only a front surface of the frame 310 is exposed.

The frame 210 may include a hole 314 through which the holder is coupled or decoupled, to provide a space in which the latch 320 is mounted. The hole 314 may be similar to or the same as the front/lower hole(s) according to the embodiment mentioned above.

A latch coupling portion 315 may be provided in the frame 310 and a shaft 311 having the latch 320 rotatably coupled thereto is provided in the latch coupling portion 315.

The shaft 311 may be projected from an inner surface of the latch coupling portion 315 and the latch 320 is rotatably coupled to the shaft 311. Here, the latch 320 may be rotated on the shaft 311 as its axis. The latch 320 may be rotatable on the shaft 311 in a horizontal direction. In addition, the latch 320 may be rotatable on the shaft 311 as its axis in a vertical direction.

The shaft 311 shown in FIG. 9 may be rounded along a circumference of a top end thereof. The shaft 311 may be formed in a cone shape. The rounded end portion of the shaft 311 may be insertedly coupled to a shaft coupling portion 324 of the latch 220. This may be referred to as "a shaft coupling end".

The latch 320 may lock or unlock the home bar door 40, while contacting the holder 100 in opening and closing the home bar door 40. The latch 320 may be coupled to the shaft 311 via the shaft coupling portion 324 formed in a predetermined portion thereof. The latch 320 may be rotatably coupled to the frame 320 via the shaft 311.

More specifically, the latch 320 can be rotatably fixed once the shaft 311 is accommodated in a shaft accommodating portion 324*a* formed in the shaft coupling portion 324.

As shown in FIGS. 7 and 8, an elastic member 330 may be inserted in the shaft coupling portion 324. One end of the elastic member 330 is fixed to the latch 320 and the other end may be fixed to the frame 310. As the latch 320 is rotated, elasticity is generated in the elastic member 330.

The elastic member 330 may be a coil spring, in other words, an elastic member having a predetermined length in a vertical direction. The elastic member 330 may generate elasticity with respect to vertical rotation of the latch 320. When the latch 320 is rotated on the shaft 311 in a vertical direction, the elastic member 330 may generate the elasticity.

An inner diameter of the shaft accommodating portion 324*a* may be larger than an outer diameter of the shaft 311 to make the vertical rotation of the latch 320 possible, as shown in FIGS. 7 and 8. Also, a rounded shape of one end of the shaft 311 may allow the shaft receiving portion 324*a* and the shaft 311 not to interfere with each other when the latch 320 is rotated vertically.

In addition, an outer diameter of the elastic member 330 may correspond to an inner diameter of the shaft receiving portion 324*a* such that the elastic member 330 may be disposed between the shaft receiving portion 324*a* and the shaft 311. Even though there is a spaced distance between the shaft receiving portion 324*a* and the shaft 311, a center of the shaft 311 may elastically restitute in a corresponding direction by the elastic member 330.

The coupling relation among the latch 320, the elastic member 330 and the shaft 311 may allow the latch 320 to perform elastic rotation and elastic restoring rotation in a horizontal direction. Also, the latch 320 may perform elastic rotation and elastic restoring rotation with respect to the shaft 311 in a vertical direction. When the latch 320 is elastically rotated in a vertical direction, a predetermined portion of the latch 320 presses a predetermined portion of the elastic member 330 in a vertical direction. Once the external force is removed, the pressed portion of the elastic member 330 is elastically restored and the latch may elastically restitute in a vertical direction.

As shown in FIG. 8, when a right end of the latch 320 is pressed downward, the latch 320 is elastically rotated in a clockwise direction. When the external force is removed, the latch 320 is elastically rotated in the reverse direction (in a counter-clockwise direction) to a restored position.

To prevent the latch 320 from being rotated too much when it is rotated to restitute, a stopper protrusion 316 may be formed in an inner circumferential surface of the frame 310, adjacent to the shaft 311. Corresponding to that, a stopper 328 may be formed in a predetermined portion of the latch 320 to be hooked to the stopper protrusion 316 when the latch 320 is rotated to restitute.

Referring to FIGS. 10, 11, 12, 13, 14 and 15, the specific structure of the latch 320 according to this embodiment and a process of locking or unlocking the home bar door 40 are described as follows.

Figure 10:
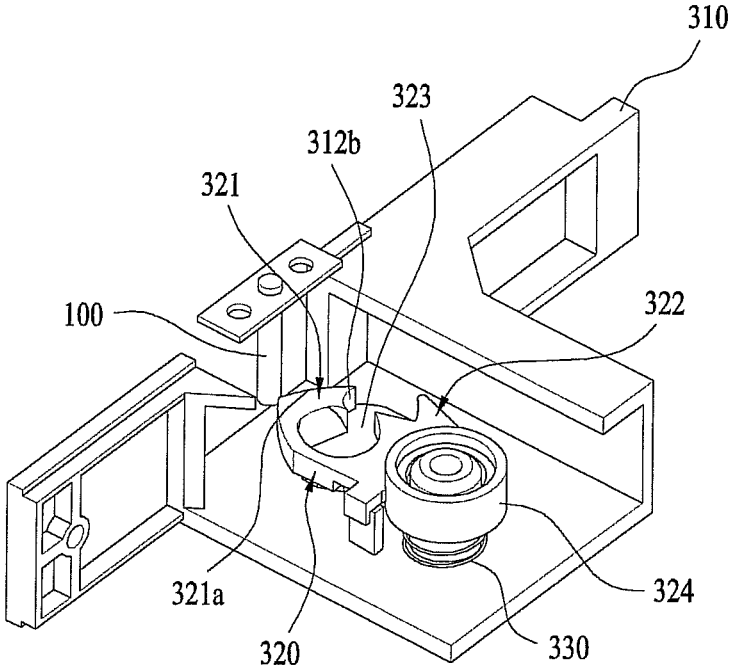
FIGS. 10 through 15 sequentially illustrate coupling and decoupling between the latch assembly and the holder shown in FIG. 7.
Figure 11:
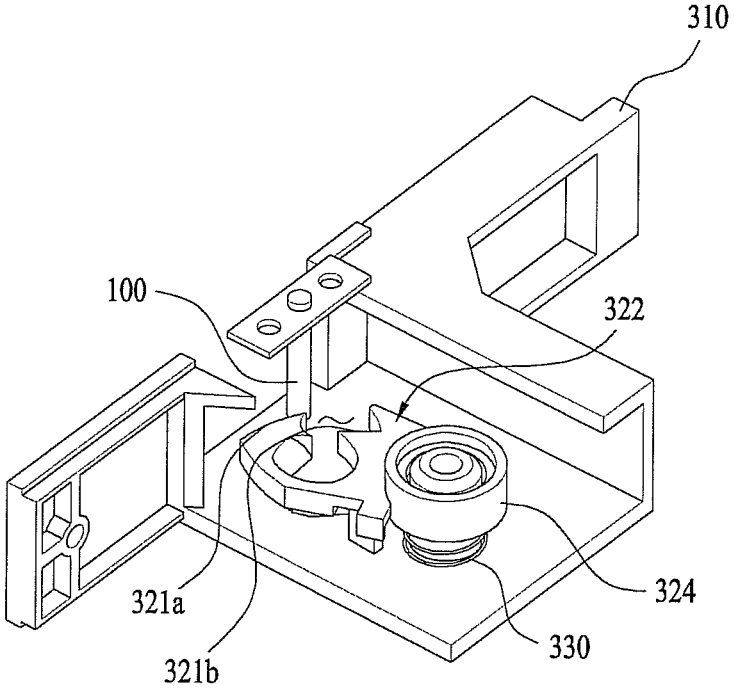
Figure 12:
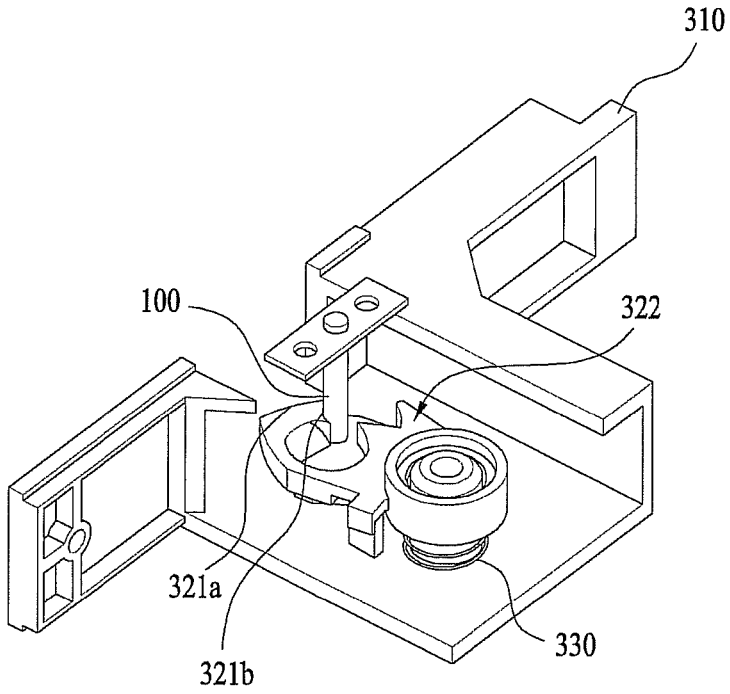
Figure 13:
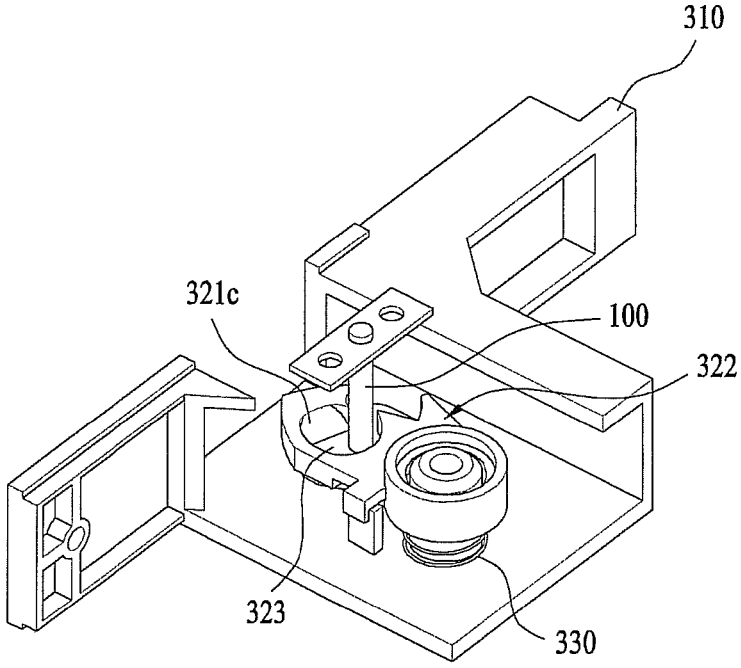
Figure 14:
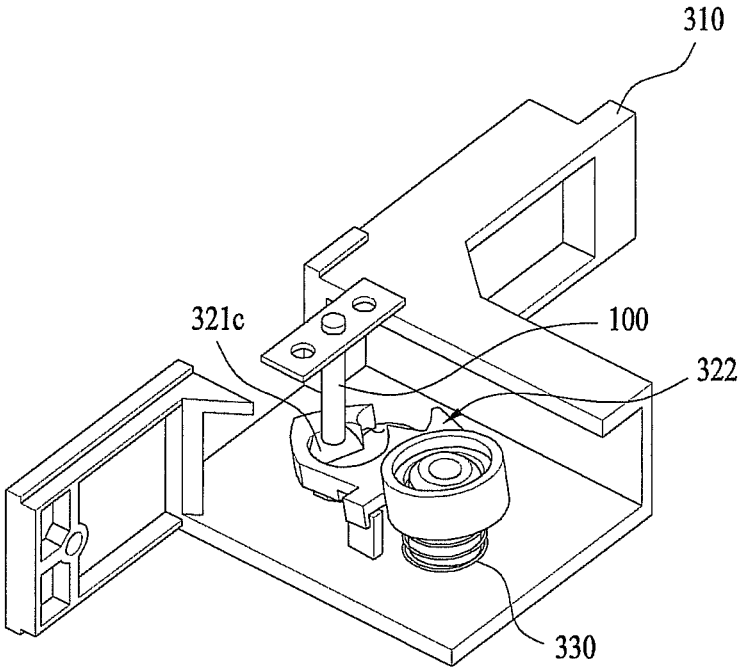
Figure 15:
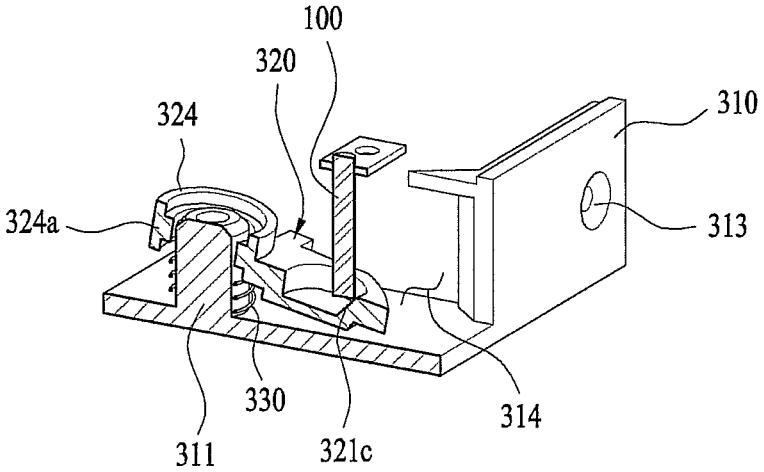

FIG. 10 is a perspective view of the holder in contact with the latch. FIG. 11 is a perspective view of the latch rotated by the forward motion of the holder. FIG. 12 is a perspective view of the holder coupled to the latch after moved farther forward. FIG. 13 is a perspective view of the holder decoupled after moving farther forward. FIG. 14 is a perspective view of the holder decoupled after moving backward. FIG. 15 is a longitudinal sectional view of the holder decoupled from the latch after moving backward.

The latch 320, according to this embodiment, moved by the holder 100 to lock or unlock the home bar door 40 may include a connecting portion for connecting the latch portion 321 and the shaft coupling portion 324.

The latch portion 321 may include a first guide portion 321*a*. The first guide portion 321*a* may be inclined in a front portion of the latch portion 321 and the first guide portion 321*a* may rotate the latch 320 in one direction as it is pushed out by the holder 100. In other words, when the holder 100 is moved forward until it is in a state of FIG. 11 from a state shown in FIG. 10, an outer circumferential surface of the holder 100 contacts the first guide portion 321*a* and rotates the latch 320 in a counter-clockwise direction. The first guide portion 321*a* may guide the holder 100 to a locking portion 321*b*.

More specifically, the first guide portion 321*a* shown in FIG. 10 is provided behind the latch 320 and guides the holder 100 to the locking portion 321*b*. When the holder 100 is continuously pressing the home bar door 40 to push the first guide portion 321*a* forward, the first guide portion 321*a* shown in FIG. 11 is pushed in one direction and the latch 320 is then rotated in one direction. At this time, the latch 320 is elastically supported by the elastic member 330. While the holder 100 is pushing the first guide portion 321*a*, the contact state between the holder 100 and the first guide portion 321*a* can be maintained continuously and the latch 320 is then elastically rotated.

The locking portion 321*b* may be connected with the first guide portion 321*a* and lock the holder 100 having passed the first guide 321*a*, only to lock the home bar door 40.

More specifically, when the holder 100 shown in FIG. 11 is moved farther forward, the contact between the holder 100 and the first guide portion 321 is released. At this time, the external force applied to rotate the latch 320 is removed and the latch 320 elastically rotated to restitute. In other words, the latch 320 is rotated in the reverse direction and the locking portion 321*b* and the holder 100 contact each other, to lock the home bar door 40 as in the locked state shown in FIG. 12.

The user can press the home bar door 40 to open the home bar door 40 from the closed/locked state. At this time, the holder 100 may be moved farther forward from the state shown in FIG. 12. Accordingly, the contact between the holder 100 and the latch 320 is released and the latch 320 is elastically rotated to restitute in a clockwise direction.

The holder 100 is inserted, in the latch 320 via a channel 323 formed behind the connecting portion 322 of the latch 320, as shown in FIG. 13. In this embodiment, different from the embodiment shown in FIGS. 4-6E, the channel 323 may be formed for the holder 100 not to pass completely through the latch 320 but to pass partially through the latch 320.

In a state shown in FIG. 13, the contact between an outer circumferential surface of the holder 100 and the latch 320 is released, and then the force applied to push the holder 100 is removed and the home bar door 40 then starts to open.

As shown in FIGS. 14 and 15, the holder 100 is moved backward by the weight of the home bar door 40 or the elastic restoring force. At this time, a bottom surface of the holder 100 (a vertical end surface of the holder 100) contacts the second guide portion 321*b*. As the holder 100 contacts the second guide portion 321*b*, the latch 320 is elastically rotated with respect to the shaft 311. Here, the rotation of the latch 320 may be a vertical direction rotation.

The second guide portion 321*b* may be an inclined surface. When the holder is moved in contact with the second guide portion 321*b*, the latch 320 may be continuously rotated. After that, the holder 100 is decoupled from the second guide portion 321*b* and the latch 320 is then rotated and restored to an original position.

The refrigerator according to at least one of the embodiments may have a simple structure that allows the latch to lock the holder, while the latch is moved by the holder in communication with the home bar door. Accordingly, the home bar door can be locked or unlocked by the simple structure, leakage of cold air via the locking device may be reduced, and heat insulation performance of the refrigerator can be enhanced.

As mentioned above, the latch assembly according to the embodiments may be applied not only to refrigerators but also to a variety of home appliances having a door. Accordingly, the latch assembly may be configured to lock or unlock a door provided with a home appliance.

Exemplary embodiments may provide a latch assembly and a refrigerator including the same.

Exemplary embodiments may provide a latch assembly having a small size and a small number of parts and a refrigerator including the same.

Exemplary embodiments may provide a refrigerator which may reduce power consumption by enhancing heat insulation between a home bar and a refrigerator door and prevent dew from forming on the home bar door and the refrigerator door.

Exemplary embodiments may provide a refrigerator which may increase a coupling force between a latch assembly and a holder of a home bar door when a home bar door is closed.

Exemplary embodiments may provide a refrigerator which may reduce power consumption by enhancing sealing between the home bar door and the refrigerator door.

Exemplary embodiments may provide a refrigerator which may prevent a holder of the home bar door from separating from the latch assembly suddenly.

Exemplary embodiments may provide a refrigerator which may prevent damage to a holder by forming a projected direction of the holder in parallel with a front surface or rear surface of the home bar door.

Exemplary embodiments may provide a latch assembly having use convenience and a simple structure, and a home appliance including the same.

A refrigerator as embodied and broadly described herein may include a latch assembly having a holder provided in a home bar door and a latch selectively coupled to the holder to lock and unlock the home bar door, wherein the latch locks the holder by changing elastic rotation of the latch in one direction into elastic restoring rotation in the reverse direction as the holder is moved forward, and the latch unlocks the holder as the holder is moved farther forward, and the latch and the holder are decoupled from each other while the latch is elastically rotated as backward motion of the holder. As the holder is moved farther forward, the latch is rotated further in the reverse direction and the locking of the holder is unlocked.

In another embodiment, a refrigerator may include a latch assembly having a holder provided in a home bar door and a latch selectively coupled to the holder to lock and unlock the home bar door, wherein the latch includes a first guide portion for elastically rotating the latch, in contact with the holder, when the holder is moved forward in the frame by an external force; a locking portion for locking the holder by the elastic restoring rotation of the latch, when the holder is, moved farther forward by the external force; and a second guide portion for guiding the backward motion of the holder by elastically rotating the latch, in contact with the holder, when the external applied to move the holder farther backward is removed.

In another embodiment, a latch assembly for a home bar door, as embodied and broadly described herein, may include a frame; a latch rotatably provided in the frame to lock a holder provided in the home bar door selectively; and a spring for generating elastic rotation and elastic restoring rotation of the latch, wherein the latch includes a first guide portion for elastically rotating the latch, in contact with the holder, when the holder is moved forward in the frame by an external force; a locking portion for locking the holder by the elastic restoring rotation of the latch, when the holder is moved farther forward by the external force; and a second guide portion for guiding the backward motion of the holder by elastically rotating the latch, in contact with the holder, when the external applied to move the holder farther backward is removed.

In a still another embodiment, a refrigerator may include a door; a home bar provided in the door; a home bar door rotatable to open and close the home bar selectively; a latch assembly provided in the door or the home bar, with a hole, the latch assembly comprising a latch elastically rotatable to lock and unlock the home bar door; and a holder provided in the home bar door, the holder movable forward and backward via the hole to be selectively coupled to the latch, wherein the latch includes a first guide portion provided to contact with an outer circumferential surface of the holder, when the holder is moved forward via the holder, to rotate the latch in one direction; a locking portion provided to contact with an outer circumferential surface of the holder, as the latch is rotated in the reverse direction by the holder decoupled from the first guide portion after moved farther forward; and a second guide portion provided to contact with the holder as the latch is rotated further in the reverse direction by the holder decoupled from the locking portion after moved farther forward.

The holder may generate the elastic rotation of the latch, while contacting with an outer surface of the latch. When the contact between the holder and the latch is released, the latch may be elastically rotated to restitute.

The latch assembly may include a frame having a hole and the latch may be provided in the frame in an elastically rotatable state.

The holder may be moved forward and backward in the frame, when passing through the hole in a vertical position. Accordingly, the holder may be moved forward and backward in the frame, in a substantially vertical position.

The holder may be formed in a cone shape. Accordingly, smooth contact between an outer circumferential surface of the holder and an outer surface of the latch may be possible.

The frame may include a shaft as an axis of the rotation of the latch and the latch is rotated on the shaft in a horizontal direction.

The first guide portion and the locking portion may contact with an outer circumferential surface of the holder, when the holder is moved forward.

The second guide portion may contact with an outer circumferential surface of the holder when the holder is moved backward. The latch may be elastically rotated in a horizontal direction, when the holder is moved backward.

The second guide portion may contact with a bottom surface of the holder, when the holder is moved backward. The latch may be elastically rotated in a vertical direction, when the holder is moved backward.

A locked state of the locking portion may be unlocked, as the holder having the locking portion in a locked state is moved forward as far as a distance which is the same or shorter than an outer diameter of the holder. Accordingly, the sealing between the home bar door in the closed state and the refrigerator door may be enhanced.

The holder may be projected to be horizontal with a front surface of the home bar door, in a state where the home bar door is open completely.

In still another embodiment, a latch assembly including a latch may be selectively coupled to a cone-shaped holder mounted in a door of a home appliance, to lock and unlock the door, the latch assembly including a frame comprising a hole where the holder penetrates; an elastic member provided in a shaft provided in the frame to allow the latch to elastically rotate on the shaft as its axis; a first guide portion inclinedly formed in a rear portion of the latch to rotate the latch along forward motion of the holder; a locking portion formed in front of the first guide to maintain a locked state of the door as the holder is moved forward after decoupled from the first guide portion; a third guide portion inclinedly spaced apart a predetermined distance from the first guide portion to rotate the latch as the holder is moved forward after decoupled from the first guide; and a second guide portion inclinedly formed in front of the first guide to rotate the latch as the holder is moved backward after decoupled from the third guide portion, wherein the first guide, the locking portion and the second guide are continuously formed.

In still another embodiment, a latch assembly including a latch may be selectively coupled to a cone-shaped holder mounted in a door of a home appliance, to lock and unlock the door, the latch assembly including a frame having a hole where the latch penetrates; an elastic member provided in a shaft provided in the frame to allow the latch to elastically rotate on the shaft as its axis; a first guide portion inclinedly formed in a rear portion of the latch to horizontally rotate the latch along forward motion of the holder; a locking portion formed in front of the first guide to maintain a locked state of the door as the holder is moved forward after decoupled from the first guide portion; and a second guide portion inclinedly formed in front of the first guide to vertically rotate the latch as the holder is moved backward after decoupled from the third guide portion, wherein the first guide and the second guide are continuously formed.

In a refrigerator as embodied and broadly described herein, the size of the latch assembly for opening and closing the home bar door may be reduced as much as possible. As the size of the latch structure is reduced as much as possible, a sufficient space where a heat insulation unit is formed can be reduced in the refrigerator door. Accordingly, a heat insulation performance of the refrigerator door or the home bar door may be increased.

According to the embodiments as broadly described herein, the latch assembly having the simple configuration can be fabricated. Also, it may be possible to mount the latch assembly in the refrigerator efficiently and easily.

According to the embodiments as broadly described herein, the coupling between the latch assembly and the holder may be increased. Reliability on the opening/closing process of the home bar door may be enhanced.

According to the embodiments as broadly described herein, the sealing between the home bar door and the refrigerator door may be enhanced. The refrigerator having low power consumption may be provided.

According to the embodiments as broadly described herein, the projected direction of the holder is horizontal with the front or rear surface of the home bar door. Accordingly, the refrigerator capable of preventing damage to the holder may be provided.

According to the embodiments as broadly described herein, the holder of the home bar door may be prevented from separating from the latch assembly drastically.

According to the embodiments as broadly described herein, the latch assembly having use convenience and a simple structure and a home appliance including such the latch assembly may be provided.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A home appliance, comprising:
a body;
a main door coupled to the body;
an auxiliary door coupled to the main door;
a latch assembly that selectively locks and unlocks the auxiliary door, the latch assembly comprising:
a holder provided in one of the main door or the auxiliary door;
a frame provided in the other of the main door or the auxiliary door, the frame having a shaft;
a latch coupled to the shaft and configured to selectively lock and unlock the holder, the latch comprising:
a first guide surface formed at a first portion of the latch;
a second guide surface at a second portion of the latch; and
a locking surface formed at a third portion of the latch; and
an elastic member coupled to the latch and the frame,
wherein the latch engages the holder in response to an elastic rotation of the latch in a first direction that is changed into an elastic restoring rotation in a second direction as the holder moves in a forward direction into the latch,
the latch disengages the holder in response to movement of the holder further forward into the latch, and
the latch and the holder are disengaged as the holder is moved backward out of the latch and the latch is elastically rotated.

2. The home appliance of claim 1, wherein the elastic rotation of the latch is generated in response to contact between the holder and an outer surface of the latch.

3. The home appliance of claim 2, wherein the frame has an opening formed therein, and the latch is rotatably installed in the frame.

4. The home appliance of claim 3, wherein the holder is configured to pass through the opening in the frame in a vertical position to move into and out of the frame.

5. The home appliance of claim 4, wherein the holder has a conical shape.

6. The home appliance of claim 5, wherein the shaft defines a vertical axis of rotation of the latch such that the latch is coupled to the shaft and rotates horizontally about the shaft.

7. The home appliance of claim 1,
wherein the latch is elastically rotated in response to contact between the first guide surface and the holder as the holder is moved in a direction into the frame by an external force,
the holder is engaged by the locking surface in response to the elastic restoring rotation of the latch as the holder is moved further into the frame, and
the latch is elastically rotated again in response to contact between the second guide surface and the holder as the external force is removed and the holder moved in a direction out of the frame.

8. The home appliance of claim 7, wherein the first guide surface and the locking surface each contact an outer circumferential surface of the holder when the holder is moved forward in the direction into the frame.

9. The home appliance of claim 8, wherein the second guide surface contacts an outer circumferential surface of the holder when the holder is moved backward in the direction out of the frame.

10. The home appliance of claim 9, wherein the latch is elastically rotated in a horizontal direction, about a vertical axis of rotation, when the holder is moved backward in the direction out of the frame.

11. The home appliance of claim 8, wherein the second guide surface contacts a distal end of the holder when the holder is moved backward in the direction out of the frame.

12. The home appliance of claim 11, wherein the latch is elastically rotated in a vertical direction, about a horizontal axis of rotation when the holder is moved backward in the direction out of the frame.

13. The home appliance of claim 7, wherein a locked state of the locking surface and the holder is released as the holder is moved forward into the latch a distance that is less than or equal to an outer diameter of the holder.

14. The home appliance of claim 7, wherein the holder is oriented in a direction that is perpendicular to a front surface of the main door when the auxiliary door is in a fully open position with respect to the main door.

15. A refrigerator, comprising:
a main door;
an auxiliary storage space provided in the main door;
an auxiliary door rotatably coupled to the main door to selectively open and close the auxiliary storage space;
a latch assembly provided in one of the main door or the auxiliary door, the latch assembly comprising a latch elastically rotatable to selectively lock and unlock the auxiliary door; and
a holder provided in the other of the main door or the auxiliary door, the holder movable in a forward direction into the latch and in a backward direction out of the latch via an opening in the latch so as to selectively engage and disengage the latch, wherein the latch comprises:
a first guide surface formed at a first peripheral portion of the latch;
a second guide surface formed at a second peripheral portion of the latch; and
a locking surface formed at a third peripheral portion of the latch, extending between the first and second guide surfaces,
wherein the first guide portion contacts an outer circumferential surface of the holder as the holder moves into the latch in the forward direction to rotate the latch in a first direction, and
the locking surface contacts the outer circumferential surface of the holder as the holder moves further into the latch in the forward direction to rotate the latch in a second direction and to release the holder from the first guide portion, and the second surface contacts the holder as the latch is rotated further in the second direction and is released from the locking surface.

16. The refrigerator of claim 15, wherein the latch is elastically rotated in response to contact between the second guide surface and the holder as the holder is moved in the backward direction.

17. The refrigerator of claim 16, wherein the holder is oriented in a substantially vertical position as it is moved in the forward and backward directions in the latch assembly.

18. The refrigerator of claim 17, further comprising a channel formed between the locking surface and the second guide surface of the latch to allow the holder to pass through a predetermined portion of the latch.

19. The refrigerator of claim 17, wherein the latch is elastically rotated in a horizontal direction, about a vertical axis of rotation, as an outer circumferential surface of the holder contacts the second guide surface.

20. The refrigerator of claim 17, wherein the latch is elastically rotated in a vertical direction, about a horizontal axis of rotation, as a distal end of the holder contacts the second guide surface.

21. A home appliance, comprising:

a body;

a main door coupled to the body;

an auxiliary door coupled to the main door;

a latch assembly that selectively locks and unlocks the auxiliary door, the latch assembly comprising:

a holder provided in one of the main door or the auxiliary door;

a latch provided in the other of the main door or the auxiliary door;

a frame comprising an opening configured to receive the holder;

a shaft provided on the frame, wherein the latch is rotatably provided on the shaft;

an elastic member provided on the shaft to allow the latch to elastically rotate on the shaft;

a first guide surface formed at an incline on a rear portion of the latch, wherein the latch is rotated in response to forward motion of the holder along the first guide surface;

a locking surface formed in front of the first surface to engage the holder and maintain a locked state of the door as the holder is moved further forward and released from the first guide surface;

a second guide surface formed at an incline in front of the first guide surface; and a third guide surface formed at an incline and spaced apart a predetermined distance from the first guide surface, wherein the latch is rotated in response contact between the holder and the third guide surface as the holder is moved forward and is released from the first guide surface, and the latch is rotated in response to contact between the holder and the second guide surface as the holder is moved backward and is released from the third guide surface, wherein the first guide surface, the locking surface and the second guide surface are continuously formed.

22. A home appliance, comprising:

a body;

a main door coupled to the body;

an auxiliary door coupled to the main door;

a latch assembly that selectively locks and unlocks the auxiliary door, the latch assembly comprising:

a holder provided in one of the main door or the auxiliary door;

a latch provided in the other of the main door or the auxiliary door;

a frame comprising an opening through which the holder penetrates to move into and out of the latch and a shaft to rotatably couple the latch to the frame;

an elastic member provided on the shaft to allow the latch to elastically rotate about the shaft;

a first guide surface formed at an incline at a rear portion of the latch to rotate the latch horizontally, about a vertical axis of rotation, in response to contact with the holder as the holder moves in a forward direction into the frame;

a locking surface formed in front of the first guide surface to engage the holder and maintain a locked state of the door as the holder is moved further forward into the frame and is released from the first guide surface; and a second guide surface formed at an incline in front of the first guide surface to rotate the latch vertically about a horizontal axis of rotation, in response to contact with the holder as the holder is moved in a backward direction out of the frame and is released from the locking surface, wherein the first guide surface and the second guide surface are continuously formed.

* * * * *